US006877849B2

(12) United States Patent
Gonzales

(10) Patent No.: US 6,877,849 B2
(45) Date of Patent: Apr. 12, 2005

(54) PRINTING SYSTEM WITH HIGH VOLUMETRIC INK CONTAINER VESSEL

(75) Inventor: Curt G. Gonzales, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 123 days.

(21) Appl. No.: 10/349,613

(22) Filed: Jan. 23, 2003

(65) Prior Publication Data

US 2004/0145636 A1 Jul. 29, 2004

(51) Int. Cl.[7] ..... B41J 2/175
(52) U.S. Cl. ..... 347/86
(58) Field of Search ..... 347/85, 86, 87

(56) References Cited

U.S. PATENT DOCUMENTS

| | | | | |
|---|---|---|---|---|
| 5,146,243 A | | 9/1992 | English et al. | 346/140 |
| 5,600,358 A | | 2/1997 | Baldwin et al. | 347/87 |
| 5,956,054 A | | 9/1999 | Hirabayashi et al. | 347/37 |
| 6,000,788 A | * | 12/1999 | Iida | 347/86 |
| 6,186,621 B1 | | 2/2001 | Pew | 347/86 |
| 6,231,173 B1 | | 5/2001 | Pawlowski, Jr. et al. | 347/86 |
| 6,276,788 B1 | | 8/2001 | Hilton | 347/86 |
| 6,286,944 B1 | | 9/2001 | Shimizu et al. | 347/86 |
| 6,286,945 B1 | | 9/2001 | Higuma et al. | 347/86 |
| 6,511,168 B1 | * | 1/2003 | Higuma | 347/86 |

* cited by examiner

*Primary Examiner*—Anh T. N. Vo

(57) ABSTRACT

A printing system includes a high volumetric efficient free-ink container vessel. The vessel includes an autonomous venting system, which supplies air to, and/or seals, the interior of the ink container in concert with an ink delivery system without reliance on external mechanical devices, feedback or control systems. The autonomous vent system includes a flexible diaphragm with a hole. The autonomous vent system is configured to autonomously open the diaphragm hole to permit atmospheric air to enter the vessel when ink is extracted from the vessel by the ink delivery system, and autonomously close the diaphragm hole when the ink delivery system is inactive. Closing and opening of the hole is actuated by pressure differentials between the interior of the ink container and atmospheric ambient pressure.

11 Claims, 4 Drawing Sheets

PRINTING SYSTEM WITH HIGH VOLUMETRIC INK CONTAINER VESSEL

BACKGROUND

1. Field of the Invention

The present invention relates to printing systems, and more particularly, to printing systems that make use of ink container vessels for delivery of ink to printing delivery systems.

2. Related Art

Printing systems, such as ink-jet printing systems, typically use ink container vessels. Most ink container vessels used in popular printing systems today deploy some type of solid material within their reservoirs such as porous material or collapsible film. The porous material and/or collapsible films are used in the vessel containers to provide a means of preventing ink from leaking out of vents in the containers. For instance, it is common for reservoir pressure to build-up in vessels due to upsurges in temperature or changes in altitude which can result in ink leakage. These solid parts also prevent spillage of ink through vent holes of the container vessels during shipment and handling of them.

Such ink container vessels are typically purchased pre-filled with ink and are discarded after they run out of available ink. A serious drawback of such vessels, however, is that they often strand between 15% and 50% of their initial total fill of ink after depleting available ink for the printing system. "Strand" means that ink remains in the container vessels and cannot be accessed by the printing system. In other words, most current ink container vessels permanently leave behind up to half their initial volume of total ink in the vessel when the container needs to be discarded. Ink becomes trapped and lodged in nooks of the container to become permanently stranded and/or becomes trapped in porous materials used inside a vessel to retain the ink.

Moreover, volumetric efficiency of an ink supply container vessel suffers because of the presence of solid materials throughout the reservoir of a vessel. Such solid parts fill volume that may otherwise be used to store ink. Additionally, printer manufacturers often construct ink container vessels with larger volumetric ink capacities, in order to compensate for the stranding of large percentages of ink. Unfortunately, larger vessels also increase the total size of printer products, because printer systems must be able to accommodate these larger vessels. Larger vessels also require higher initial fill volumes of ink, which is costly.

Furthermore, current ink container vessels are also environmentally unfriendly; because they often cannot be recycled due to the amount of stranded ink left in the vessels once they have to be discarded (i.e., once there is no available ink for printing).

To date, attempts to create ink container vessels that do not strand ink and are volumetric efficient are too costly or are ill-suited with the conveniences of current print system designs.

SUMMARY

The present invention is directed to a printing system that includes a high volumetric, free-ink container vessel for supplying ink to the printing system. In one embodiment, the ink container vessel includes a vent hole and an autonomous vent system. An ink delivery system is coupled to the vessel for the purpose of extracting ink stored in the vessel for the printing system. The autonomous vent system uses a flexible diaphragm to cover the vent hole. The autonomous vent system also has a diaphragm hole that is smaller than the vent hole. The autonomous vent system is configured to autonomously open the diaphragm hole to permit atmospheric air to enter the vessel when ink is extracted from the vessel by the delivery system, and autonomously close the diaphragm hole when the delivery system is inactive.

The exemplary printing system, therefore, introduces the broad concept of employing an autonomous vent supply for an ink container vessel. The vent is able to control the supply of air to the interior of the vessel in concert with the ink delivery system, without manipulation of other devices and control systems. As a result of innovative concepts herein, only a residual portion of ink is stranded in ink container vessels after the available ink supply is fully depleted.

In another implementation, the exemplary description is directed to an ink container that has a vent hole located through the exterior shell of the container. The container also contains an autonomous vent system, which comprises a flexible diaphragm fitted over the vent hole. The diaphragm has a diaphragm hole that is smaller than the vent hole. The diaphragm hole is also positioned over the vent hole. Accordingly, an interior side of the flexible diaphragm faces the interior side of the container and the exterior side of the flexible diaphragm faces atmospheric air. A sealing member is configured to press against the exterior side of the diaphragm and seal the diaphragm hole when the pressure in the container, (which is exerted against the interior side of the diaphragm) is greater than atmospheric pressure exerted against the exterior side of the diaphragm. On the other hand, when atmospheric air pressure exerted against the exterior side of the diaphragm exceeds the pressure inside the vessel, the flexible diaphragm is configured to flex away from sealing member and toward the interior side of the vessel.

One feature of the exemplary printing system is that the autonomous venting system does not add cost or complexity to a printer system, because the vent system relies on pressure differences between the reservoir of the ink container and the atmosphere exerted against the diaphragm, to control the flow of air to the ink container and/or seal the reservoir of a vessel from ink excursions or drying external air flow.

Another feature of the exemplary printing system is the ability to employ "free-ink" (that is, without the use of porous, absorbent, or solid materials in the reservoir, such as foam mentioned in the Background Section above) container vessels, which enables the highest volumetric efficiency for ink storage, while simultaneously providing for a greater variety of container shapes than non-"free-ink" vessels. Free-ink vessels are also friendlier to the environment than conventional ink vessels, which are not recyclable and often leak ink into the environment once discarded.

Still another feature of the exemplary printing system is a tremendous reduction of stranded ink. Ink containers employing the inventive concepts described herein typically strand less than three percent of the total initial fill volume of the ink container, which is between 5-to-16 times better than current porous media and film containers.

Further features and advantages, as well as the structure and operation of various embodiments are described in detail below with reference to the accompanying drawings.

BRIEF DESCRIPTION OF THE DRAWINGS

The detailed description is described with reference to the accompanying figures. In the figures, the left-most digit(s) of a reference number identifies the figure in which the reference number first appears.

DETAILED DESCRIPTION

Figure 1:
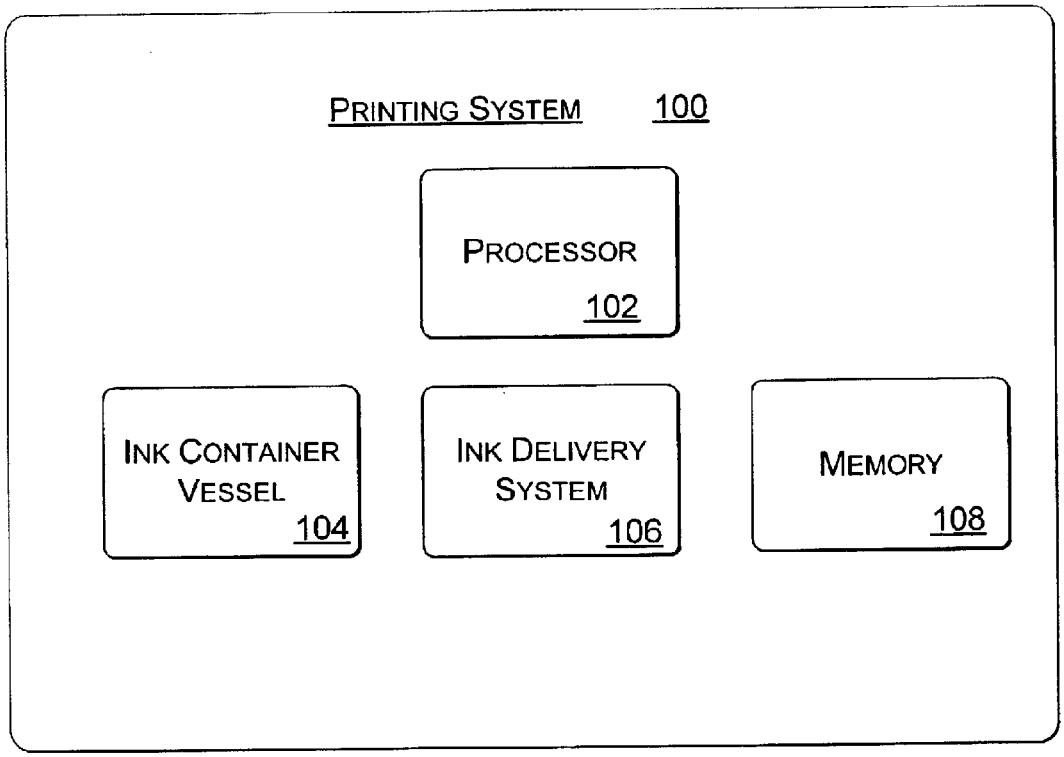
FIG. 1 is a simplified block diagram of an exemplary ink-jet printing system 100 that can be utilized to implement the inventive techniques of the present invention.

FIG. 1 is a simplified block diagram of an exemplary ink-jet printing system 100 that can be utilized to implement the inventive techniques of the present invention. As used herein, "printing system" means any electronic device having data communications, data storage capabilities, and/or functions to render printed characters and images on a print media. A printing system may be a printer, fax machine, copier, plotter, and the like. The term "printing system" includes any type of printing device using a transferred imaging medium, such as ejected ink, to create an image on a print media. Examples of such a printer can include, but are not limited to, inkjet printers, plotters, portable printing devices, as well as multi-function combination devices. Although specific examples may refer to one or more of these printers, such examples are not meant to limit the scope of the claims or the description, but are meant to provide a specific understanding of the described implementations. System 100 will now be described in more detail.

Printing system 100 includes one or more of the following: a processor 102, an ink container vessel 104, an ink delivery system 106 and memory 108. Additionally, although not shown, a system bus as well as mechanical connections, such as fluid interconnects, typically connects the various components within printing system 100. Furthermore, although well appreciated by those skilled in the relevant art, additional components of standard commercial printing systems are not described herein, as they are superfluous to understanding and describing the exemplary embodiments of the present invention.

Processor 102 processes various instructions to control the operation of system 100 and to communicate with other electronic and computing devices. Essentially processor 102 manages the overall operation of printing system 100. Whereas memory 108 is used to store instructions and messages useful for processor 102 to manage operation of system 100, including communicating with other devices. Memory 108 may include programmable and/or permanent storage of data and instructions. Various types of memory devices, depending on the complexity of system 100 may be deployed as is appreciated by those skilled in the art.

Ink container vessel 104 stores a supply of ink for the printing system 100. As used herein vessel 104 may also be referred to as a printer cartridge. Vessel 104 shall be described in more detail below, with reference to FIGS. 2 and 3. Ink delivery system 106 is typically connected to ink container vessel 104 by flexible tubing conduit or hollow needle (tubing and needle not shown but well understood by those skilled in the art). System 106 selectively extracts ink stored in vessel 104 and deposits the ink on media (not shown). Ink delivery system 106 can include an inkjet printing mechanism that selectively causes ink to be applied to a print media in a controlled fashion. It should be noted, however, that the exemplary ink delivery system 106 used with the ink container vessel is a Spring-bag pressure regulator system. Those skilled in the art will recognize, however, that there are many different types of ink delivery systems 106 available such as foam or other capillary material and that for the purposes of this description, ink delivery system 106 can include any of these different types of systems.

Figure 2:
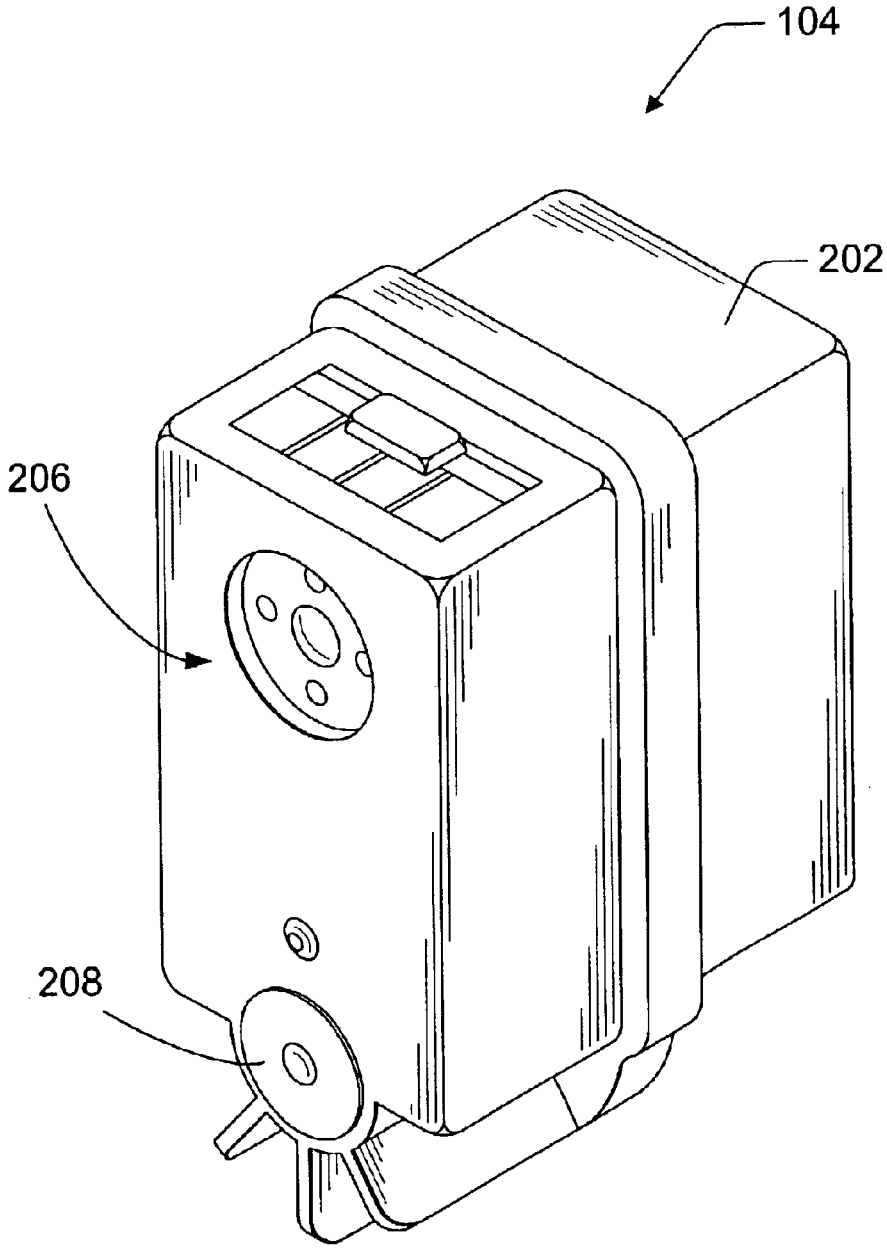
FIG. 2 is a view of an exemplary ink container vessel.

Referring to FIG. 2 is a view of an ink container vessel 104 according to an exemplary embodiment of the present invention. Ink container vessel 104 includes: a chassis 202, a reservoir 204, an autonomous vent system 206 and a septum 208. Ink container vessel 104 may be designed to be releasably installed in a receiving slot (not shown) of printing system 100. It should be noted that FIG. 2 is enlarged to better aid in illustrating the inventive features of the embodiment and is not necessarily drawn to scale.

Chassis 202 is preferably composed of a non-collapsible rigid (or semi-rigid) material and may be formed of many different shapes not limited to FIG. 2, depending on the application. For purposes of this exemplary illustration, chassis 202 is composed of rigid plastic.

Reservoir 204 is designed to store a supply of ink for delivery system 106. Reservoir 204 is internal to chassis 202 and may initially store a supply of ink up to the maximum volumetric size of reservoir 204.

Septum 208 serves as a fluid outlet for ink stored in reservoir 204. That is, ink stored in reservoir 204 is fluidly connected to septum 208. Septum 208 prevents ink from extruding from chassis 202, i.e., it acts as a sealing mechanism, when "ink container" 104 is out of the printer. On the other hand, when ink container 104 is installed in the printer, septum 208 allows fluidic connection between ink in reservoir 204 and ink delivery system 106; usually via tubing (not shown) or other fluid interconnections, such as a hollow needle (also not shown). Those killed in the art understand and appreciate the mechanics of septums.

Autonomous venting system 206 autonomously permits the supply of air to flow into reservoir 204, typically, when ink is extracted from ink reservoir 204 via septum 208. Autonomous venting system 206 also autonomously seals ink from extruding (and/or evaporating) out of reservoir 204 through venting system 206. Venting system 206 is able to seal-off the reservoir as well as permit air to enter reservoir 204, autonomously, as shall be described in more detail below with reference to FIGS. 3 and 4. Additionally, venting system 206 is able to operate when ink is in fluidic contact with it or not, e.g., when reservoir is only half full and the ink level is below venting system 206. It should also be noted that venting system 206 is able to act in concert with ink delivery system 106, i.e., allow air to enter chassis 202 when ink delivery system 106 is active and seal-off air/seal-in ink when system 106 is inactive.

In other words, autonomous venting system 206 allows air to enter vessel 104 when ink is being consumed by printing system 100. When the printing system 100 is not consuming ink, generally autonomous venting system 206 prevents ink from drooling out during environmental excursions, such as created by thermal excusions and altitude changes. Typically, venting system 206 is located toward the top of vessel 104 as shown in FIG. 2, but may be incorporated into any other location on vessel 104 that permits adequate air supply.

Figure 3:
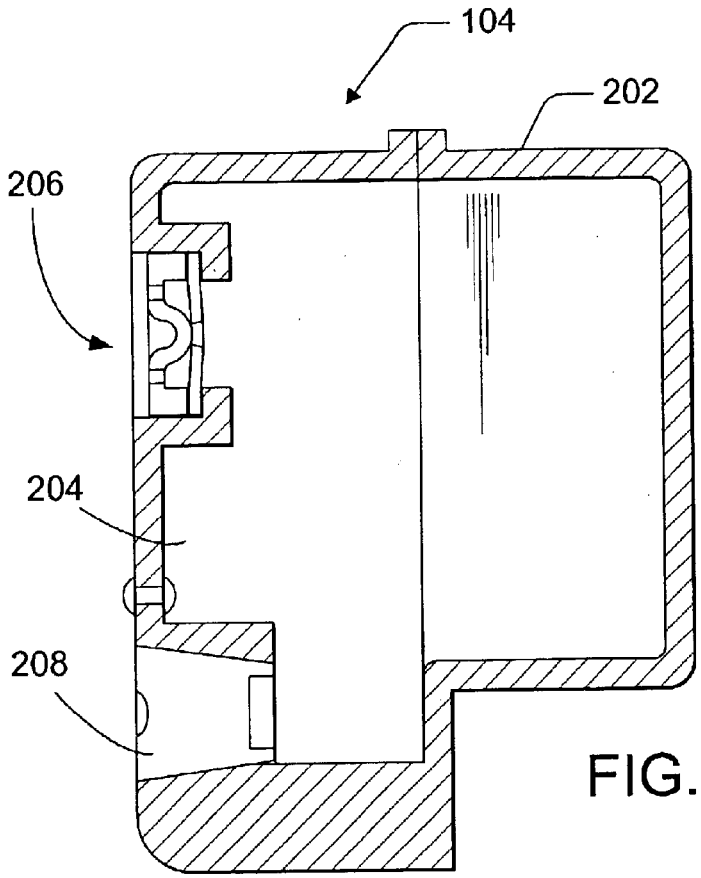
FIG. 3 is a cross sectional view of an exemplary autonomous venting system.

Referring now to FIG. 3, is a cross sectional view of an exemplary autonomous venting system 206. Venting system 206 includes: a vent hole 302, a flexible diaphragm 304, a diaphragm hole 306, a sealing member 308, and a valve encasement member 310. Venting system 206 will now be described in more detail.

Extending through chassis 202 is vent hole 302, which is located on the reservoir 204 side (or ink side) of chassis 202. Vent hole 302 has a diameter equal to X, where X may be a multitude of sizes, dependent upon the size and type of vessel 104. In the exemplary embodiment X=6.0 mm. Vent hole 302 in the exemplary illustration is round, but may be any shape. Although only one vent hole is shown in the exemplary illustration, more than one vent hole may be used in a vessel 104, depending on the size and application of the container vessel.

A flexible diaphragm 304 is inserted to fit and extend over vent hole 302, such that vent hole 302 is preferably fully covered. Accordingly, an interior side 316 of diaphragm 304 is either in fluid communication with ink stored in reservoir 204 and/or air, as ink is extracted from reservoir 204. Whereas, an exterior side 318 of diaphragm 304 is in gas communication with atmospheric pressures caused by air. Diaphragm 304 should be constructed of a flexible non-porous material. In a preferred embodiment, diaphragm is composed of EPDM elastomer material, but other elastomer, or non-elastomer materials may also be substituted for EPDM, as would be appreciated by those skilled in the relevant art. It should also be noted that diaphragm 304 could be attached to the interior side of reservoir 204 and the vent hole could be on the exterior side of 318 of diaphragm 304.

Located in the center of diaphragm 304, is at least a single diaphragm hole 306 that is preferably smaller than the diameter of vent hole 302. As shown in FIG. 3, the diameter of diaphragm hole 306 is X–L, where L is greater than 0. In the exemplary embodiment the diameter of diaphragm hole 306 is 1.2 mm. Also hole 306 is round, but may be non-circular as should be appreciated by those skilled in the art. It is also possible that more than one hole 306 of various sizes could be embedded into diaphragm 304, without departing from the scope of the claimed invention.

A sealing member 308 is positioned to press against diaphragm 304. In the exemplary embodiment sealing member 308 is positioned at the center of hole 306 and is a protruding domed shape piece of plastic, although other shapes are possible so long as the sealing member 308 provides a sealing fit when in full contact with diaphragm hole 306. A domed surface sealing member 308 allows for loser tolerances of plastic molded parts. Sealing member 308 should preferably be rigid or semi-rigid and can be in a fixed stationary position. Of course, more than one sealing member 308 could be employed, depending on the size and quantity of diaphragm holes. Sealing member 308 should preferably have a shape similar to the diaphragm hole 306 to ensure a compatible fit. Although not shown due to the perspective of FIG. 3, sealing member 308 is actually connected as a fully integrated part with encasement member 310.

Encasement member 310 is inserted in chassis 202 and is also positioned to fasten and seal the ends of diaphragm 304, which in the exemplary embodiment is shown sandwiched between chassis 202 and encasement member 310. At various locations in encasement member 310 are air holes 314 that provide a means for atmospheric pressure to be exerted against the exterior side 318 of diaphragm 304. Additionally, air holes 314 provide a path for air to flow into vent hole 302 when the seal between sealing member 308 and diaphragm hole 306 is open. In the exemplary illustration there are four air holes 314 (see also FIG. 4). Generally, it is desirable to have enough air holes 314 to provide atmospheric pressure evenly at locations across diaphragm 304, but the number of air holes chosen is a design choice of the skilled artisan.

The operation of autonomous air vent 206 will now be described in more detail. As mentioned above, diaphragm 304 is a flexible elastomer. When ink delivery system 106 is inactive sealing member 308 is pre-tuned to press against diaphragm 304 and therefore provide a seal of diaphragm hole 306. Accordingly, when ink delivery system is inactive, air does not flow into or out of diaphragm hole 306. Likewise, ink pressing on the interior side 316 of diaphragm 304 is prevented from escaping from reservoir 204 by venting system 206. It is desirable to select a diaphragm thickness and tune the tension of diaphragm 304 so that temperature and altitude changes do not cause ink to weep out of diaphragm hole 306, when ink delivery is inactive.

As ink delivery system 106 extracts ink from reservoir 204, air will eventually crack the seal between sealing member 308 and diaphragm hole 306. That is, hole 306 will stay sealed until the balance of pressure in vessel 104 reservoir 204 is negative enough to cause atmospheric air to enter diaphragm 304 via hole 306. At this point, diaphragm 304 actually flexes away from sealing member 308 and toward the inside of reservoir 204. This is caused by the greater atmospheric pressure exerted against an internal ink reservoir 204 pressure (e.g., negative reservoir pressure). Once there is a balance of pressures between (i) reservoir 204 exerted against the interior side 316 of diaphragm 304 and (ii) atmospheric pressure exerted on the exterior side of diaphragm 304, due to air entering reservoir 204 via hole 306, then the diaphragm should flex back to its pre-tuned tension position, resting against sealing member 308. It is desirable to tune the tension on the diaphragm so that air flow is only able to bubble-in.

In other words, sealing member 308 is configured to press against and seal diaphragm hole 306 on the exterior side 318 of diaphragm 304 when the ink delivery system is inactive. On the other hand, diaphragm 304 flexes away from the sealing member 308 as negative pressure builds in reservoir 204 when delivery system 106 extracts ink from vessel 104. Actually, atmospheric air pressure pushes against the exterior side 318 of diaphragm 306 and causes the diaphragm 304 to move away (i.e., flex) from sealing member 308. This movement thereby actuates atmospheric air to flow into diaphragm hole 306 and through vent hole 302 and into vessel 104. Valve encasement member 310 in conjunction with sealing member 308, should provide enough atmospheric pressure via holes 314 (also referred to as an air chamber 314) so that there is enough air flow and/or pressure exerted around the sealing member 308 and the flexible diaphragm 304.

Thus, autonomous venting system 206 opens and closes hole 306 based on differential pressures between those present on the exterior and interior sides 318, 316, respectively, of diaphragm 304. The venting system 206 is autonomous in that it regulates itself purely based on pressure differentials. No mechanically powered parts or control mechanism are needed to open or close the vessel's 104 vent 206. The system 206 is low cost and brings many advantages to the designs of printing systems 100, such as, but not limited to: free ink vessels (ink can reside in vessels without immersion venting systems such as porous material), minimized stranded residual ink (3% or less), environmentally safer containers, all plastic/rubber recyclable containers, higher volumetric capacities for containers and many other related advances.

Figure 4:
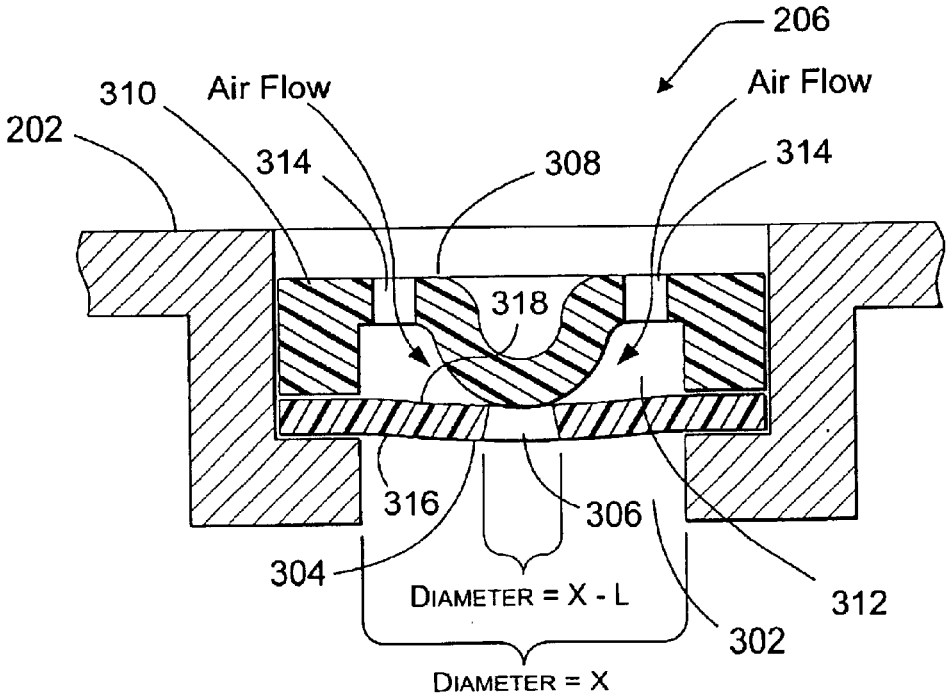
FIG. 4 is a more detailed cross sectional view of the exemplary autonomous venting system illustrated in FIG. 3.
Figure 5:
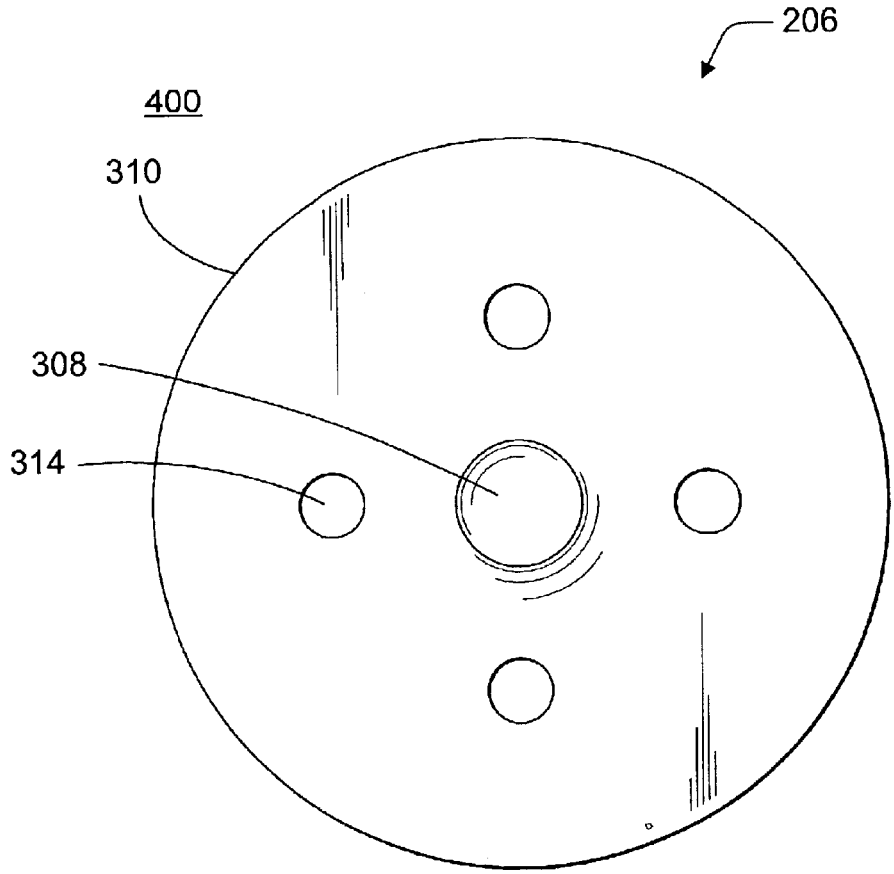
FIG. 5 illustrates a topical view of an exemplary autonomous venting system shown from the exterior of an ink containment vessel.

FIGS. 4–5 collectively illustrate autonomous venting system 206 in greater detail. FIG. 4 illustrates an exemplary cross-sectional view of autonomous venting system 206. FIG. 5 illustrates an exemplary topical view 400 of autonomous venting system 206 from the exterior of ink containment vessel 104. As shown valve encasement member 310 is a large fitted plastic member that covers diaphragm 304. Further, sealing member 308 is an integrated part of encasement member 310, except it is molded inward (away from view in FIG. 5), to form the dome shape shown in FIGS. 3–4. Holes 314 provide the basis for air to enter the encasement member to provide the passageways for proper air flow and atmospheric pressure in the air chamber of 312 (shown in FIG. 4). Manufacturers of ink vessel 104 only need to purchase two parts in addition to chassis 202: encasement member 310 and an elastomer disk for diaphragm 304. Once tolerances are determined, assembly of vessel 104 can be performed with less expense than current printer cartridges used in most printing systems, such as ink-jet printers.

While various embodiments of the invention have been described above, it should be understood that they have been presented by way of example only, and not limitation. It may be apparent to persons skilled in the relevant art that various changes in form and detail can be made therein without departing from the spirit and scope of the invention as defined in the claim(s).

What is claimed is:

1. A printing system, comprising:

an ink container vessel configured to store a supply of ink, said ink container vessel containing a vent hole;

an ink delivery system, coupled to said vessel, configured to extract ink from said vessel;

an autonomous vent system comprising a flexible diaphragm coupled to said vent hole, said diaphragm having a diaphragm hole, wherein said autonomous vent system is configured to:

(a) autonomously open said diaphragm hole to permit atmospheric air to enter said vessel when ink is extracted from said vessel by said delivery system, and (b) autonomously close said diaphragm hole when said delivery system is inactive; and, wherein said flexible diaphragm has an interior side facing said supply of ink and an exterior side facing atmospheric air wherein said autonomous vent system further comprises a sealing member configured to press against and seal said diaphragm hole on said exterior side of said diaphragm when said delivery system is inactive, wherein said flexible diaphragm flexes as negative pressure builds in said vessel when said delivery system extracts ink from said vessel, allowing atmospheric air pressure to push against said exterior side of diaphragm and cause said diaphragm to move away from said sealing member and toward the interior of said vessel, thereby actuating atmospheric air to flow into said diaphragm hole and through said vent hole and into said vessel.

2. A printing system, comprising:

an ink container vessel configured to store a supply of ink, said ink container vessel containing a vent hole;

an ink delivery system, coupled to said vessel, configured to extract ink from said vessel;

an autonomous vent system comprising a flexible diaphragm coupled to said vent hole, said diaphragm having a diaphragm hole, wherein said autonomous vent system is configured to:

(a) autonomously open said diaphragm hole to permit atmospheric air to enter said vessel when ink is extracted from said vessel by said delivery system, and (b) autonomously close said diaphragm hole when said delivery system is inactive; and, wherein said flexible diaphragm has an interior side facing said supply of ink and an exterior side facing atmospheric air wherein said autonomous vent system further comprises a sealing member configured to press against and seal said diaphragm hole when pressure inside said vessel is greater than or equal to atmospheric pressure, wherein autonomous vent system further comprises a valve encasement member, forming an air chamber around said sealing member and said flexible diaphragm.

3. An ink container vessel configured to supply ink to a printing system, the ink container vessel comprising:

a vent hole, an autonomous vent system comprising:

(a) flexible diaphragm coupled to and positioned to cover said vent hole, said diaphragm having a diaphragm hole located over said vent hole, wherein said flexible diaphragm has an interior side facing an interior side of said container vessel and an exterior side facing atmospheric air;

(b) a sealing member configured to press against said exterior side of said diaphragm and seal said diaphragm hole when pressures exerted against said interior side of said diaphragm is greater than atmospheric pressure exerted against the exterior side of said diaphragm; and wherein said flexible diaphragm is configured to flex away from said sealing member and toward said ink in said vessel when air pressures exerted against said exterior side of diaphragm are greater than pressures inside said vessel.

4. An ink container vessel configured to supply ink to a printing system, the ink container vessel comprising:

a vent hole, an autonomous vent system comprising:

(a) a flexible diaphragm coupled to and positioned to cover said vent hole, said diaphragm having a diaphragm hole located over said vent hole, wherein said flexible diaphragm has an interior side facing an interior side of said container vessel and an exterior side facing atmospheric air;

(b) a sealing member configured to press against said exterior side of said diaphragm and seal said diaphragm hole when pressures exerted against said interior side of said diaphragm is greater than atmospheric pressure exerted against the exterior side of said diaphragm; and wherein said flexible diaphragm is configured to flex away from said sealing member and toward said ink in said vessel when pressures exerted against said exterior side of diaphragm are greater than pressures inside said vessel, thereby allowing air to pass through said diaphragm hole, through said vent hole, and into said vessel.

5. An ink container vessel configured to supply ink to a printing system, the ink container vessel comprising:

a vent hole, an autonomous vent system comprising:

(a) a flexible diaphragm coupled to and positioned to cover said vent hole, said diaphragm having a diaphragm hole located over said vent hole, wherein said flexible diaphragm has an interior side facing an interior side of said container vessel and an exterior side facing atmospheric air;

(b) a sealing member configured to press against said exterior side of said diaphragm and seal said diaphragm hole when pressures exerted against said interior side of said diaphragm is greater than atmospheric pressure exerted against the exterior side of said diaphragm; and, wherein said autonomous vent system further comprises a valve encasement member attached to said vessel and having said sealing member integrally attached and protruding there from so said sealing member presses against said diaphragm.

6. An ink container vessel configured to supply ink to a printing system, the ink container vessel comprising:

a vent hole, an autonomous vent system comprising:

(a) a flexible diaphragm coupled to and positioned to cover said vent hole, said diaphragm having a diaphragm hole located over said vent hole; wherein said flexible diaphragm has an interior side facing an interior side of said container vessel and an exterior side facing atmospheric air;

(b) a sealing member configured to press against said exterior side of said diaphragm and seal said diaphragm hole when pressures exerted against said interior side of said diaphragm is greater than atmospheric pressure exerted against the exterior side of said diaphragm; and wherein said autonomous vent system further comprises a valve encasement member attached to said vessel and having said sealing member integrally attached and protruding there from so as to effectuate contact with said diaphragm, wherein said encasement member forms a chamber between said exterior side of said diaphragm and said encasement member.

7. An ink container vessel configured to supply ink to a printing system, the ink container vessel comprising:

a vent hole, an autonomous vent system comprising:

(a) a flexible diaphragm coupled to and positioned to covered said vent hole, said diaphragm having a diaphragm hole located over said vent hole, wherein said flexible diaphragm has an interior side facing an interior side of said container vessel and an exterior side facing atmospheric air;

(b) a sealing member configured to press against said exterior side of said diaphragm and seal said diaphragm hole when pressures exerted against said interior side of said diaphragm is greater than atmospheric pressure exerted against the exterior side of said diaphragm; and wherein said autonomous vent system further comprises a valve encasement member attached to said vessel and having said sealing member integrally attached and protruding there from so as to effectuate contact with said diaphragm, wherein said encasement member forms a chamber between said exterior side of said diaphragm and said encasement member, and wherein said encasement member has holes to provide flow of air from the atmosphere through said chamber and into said holes when said seal member does not fully cover said diaphragm hole.

8. A free ink container for supplying ink to an ink-jet printing system, said container comprising:

a vent hole located on an upper portion of said container, an autonomous vent system comprising:

(a) a flexible diaphragm fitted over said vent hole, said diaphragm having a diaphragm hole that is smaller than said vent hole and said diaphragm hole is also positioned over said vent hole, wherein said flexible diaphragm has an interior side facing an interior side of said container and an exterior side facing atmospheric air; and (b) a sealing member configured to press against said exterior side of said diaphragm and seal said diaphragm hole when pressure exerted against said interior side of said diaphragm is greater than atmospheric pressure exerted against the exterior side of said diaphragm, wherein said flexible diaphragm is configured to flex away from said sealing member and toward said interior side of container when air pressure exerted against said exterior side of said diaphragm is greater than pressure inside said container.

9. The free ink container vessel of claim 8, wherein air passes through said diaphragm hole, through said vent hole and to said container when said flexible diaphragm flexes away from said sealing member.

10. The free ink container vessel of claim 8, wherein in said sealing member is large enough to fully cover said diaphragm hole when said diaphragm and said member are touching each other.

11. The free ink container vessel of claim 8, wherein said autonomous vent system further comprises a valve encasement member attached to said container around said vent hole and having said sealing member integrally attached and protruding there from so that said sealing member presses against said diaphragm.

* * * * *

UNITED STATES PATENT AND TRADEMARK OFFICE

CERTIFICATE OF CORRECTION

PATENT NO. : 6,877,849 B2
APPLICATION NO. : 10/349613
DATED : April 12, 2005
INVENTOR(S) : Gonzales It is certified that error appears in the above-identified patent and that said Letters Patent is hereby corrected as shown below:

Col. 9 (line 22), delete “hole;” and insert therefor --hole,--.

Col. 9 (line 30), delete “and” and insert therefor --and,--.

Col. 9 (line 44) delete “covered” and insert therefor --cover--.

Signed and Sealed this

Twenty-second Day of August, 2006

JON W. DUDAS
*Director of the United States Patent and Trademark Office*